US005549242A

United States Patent [19]

Gimeno

[11] Patent Number: 5,549,242

[45] Date of Patent: Aug. 27, 1996

[54] STACKABLE CONTAINER WITH REINFORCED CORNERS

[75] Inventor: D. Emilio M. Gimeno, Alicante, Spain

[73] Assignee: Iberoamericana Del Embalaje S.A., Spain

[21] Appl. No.: 208,331

[22] Filed: Mar. 7, 1994

[30] Foreign Application Priority Data

Mar. 5, 1993 [ES] Spain ..... 9300592 U

[51] Int. Cl.[6] ..... B65D 5/28

[52] U.S. Cl. ..... 229/191; 229/918

[58] Field of Search ..... 229/191, 918, 229/992, 190, 915, 919

[56] References Cited

U.S. PATENT DOCUMENTS

| | | | |
|---|---|---|---|
| 2,844,293 | 7/1958 | Whitney | 229/191 X |
| 2,885,137 | 5/1959 | Guyer | 229/918 X |
| 3,079,058 | 2/1963 | Russell | 292/191 X |
| 3,093,291 | 6/1963 | Brondle | 229/125.19 X |
| 3,162,351 | 12/1964 | Rudofski | 229/191 X |
| 3,918,630 | 11/1975 | Meyers | 229/192 X |
| 4,572,426 | 2/1986 | Lisiecki | 229/190 |
| 4,799,620 | 1/1989 | Vilella | 229/191 |
| 4,905,834 | 3/1990 | Mur Gimeno et al. . | |
| 4,923,113 | 5/1990 | Guijarro . | |

*Primary Examiner*—Allan N. Shoap
*Assistant Examiner*—Christopher J. McDonald
*Attorney, Agent, or Firm*—Ostrolenk, Faber, Gerb & Soffen, LLP

[57] ABSTRACT

A stackable container has corners which have ridges that extend above the sidewall. These ridges mate with slots in the bottom walls of similar containers when the containers are stacked. Corner flaps which connect adjacent sidewalls form triangular posts that serve to support the weight of containers stacked on it. The section of the corner flap that extends along the adjacent sidewalls also have ridges that extend above the sidewall but the section that extends diagonally across the corner has a height that is equal to the height of the sidewalls. This allows this section to rest against the bottom wall of a container stacked on it instead of mating with a slot.

19 Claims, 5 Drawing Sheets

FIG.1
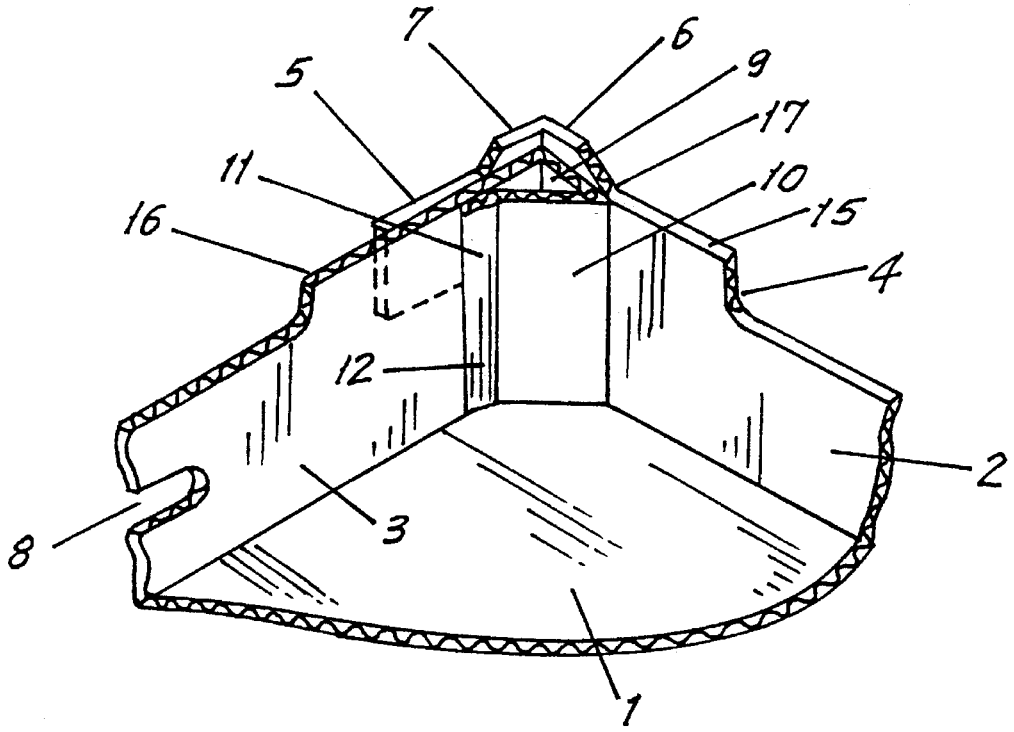
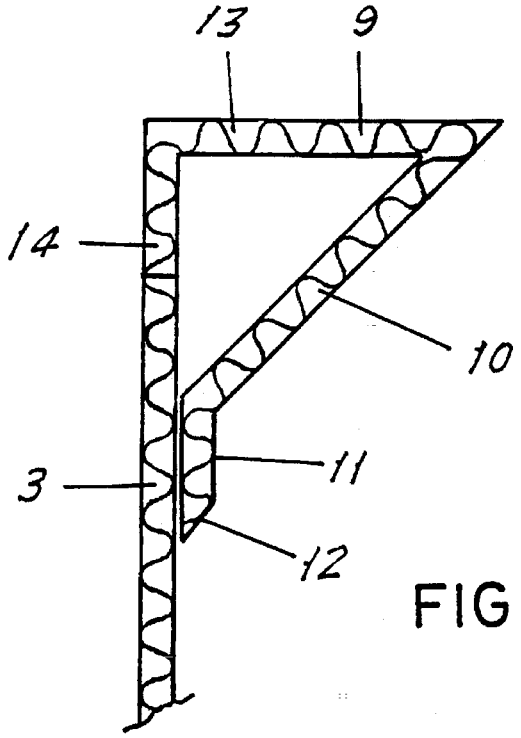
FIG.2

STACKABLE CONTAINER WITH REINFORCED CORNERS

BACKGROUND OF THE INVENTION

The present invention relates in general to a light weight container, and more specifically to a stackable container.

Under the names of "trays" and "pallets" there are already known a large number of open boxes which are used generally for the packing of perishable products, such as fresh fruit.

These boxes are generally provided with fitting and support means so as to be able to place them one above the other, forming stacks. Among the containers of this known type, particular reference should be made to the one which has been the object of registration as Utility Model No. 8801748 in the name of the owner of the present application, which model has, among other things, the characteristic feature of its angular ridge which protrudes at each corner and coinciding slots produced in the lower edge of the corners of the box in order to be able to pile several boxes connected one on top of the other.

In accordance with this embodiment, it has been possible to form very strong, light-weight containers which can be placed one on top of the other forming very stable stacks.

Upon producing this model of container in practice, it was found that the ridges formed make it necessary to provide on the lower edge of the corners of the box corresponding slots which have an effect on the bottom, the long sides and the ends of the box, which in some cases results in a weakening of the box formed.

These and other problems of no less importance are what it is precisely desired to solve by the improved light-weight container which constitutes the object of the present application for Utility Model.

BRIEF DESCRIPTION OF THE INVENTION

As has been indicated, the object of the present invention is a stackable light-weight container of the "tray" or "pallet" type which is constructed, preferably but not exclusively, by means of a sheet of corrugated cardboard formed by stamping in which there has been provided the possibility that the nesting ridges which extend from the upper edge of its corners are formed optionally by one or two thicknesses of material.

In accordance with another feature of the model, it is provided that the said nesting ridges can extend from an outer partition which surrounds the corner of the box, or else from a central partition which permits the slots produced in the lower edge of the corners to remain partially concealed and invisible from the outside and entirely concealed by the inside of the box.

Another improvement which the model introduces is due to the fact that the extensions or flaps which are articulated on the ends of the long sides have a final sector which is applied against and fastened by adhesive to the inner surface of the long side itself and the extreme edge of this final sector or flap has been suitably adjusted so that it cannot cut or mutilate the packed products which may have contact with said edge.

A more complete idea of the improvements made by the present invention is provided in the following description in which reference is had to the accompanying drawings, in which, diagrammatically and solely by way of illustration and not of limitation, there are shown the details and preferred combinations of the model, referred to possible cases of practical embodiment.

BRIEF DESCRIPTION OF THE DRAWINGS

FIG. 1 is a fragmentary perspective view of a corner of the container according to an embodiment of the present invention.

FIG. 2 is an enlarged plan view of the corner of the container of FIG. 1.

DESCRIPTION OF THE PREFERRED EMBODIMENTS

FIG. 1 shows, in perspective, a portion of the improved container proposed by the invention, looking at one of its corners. From this figure it can be seen that on each corner of the container a triangular prism is formed which constitutes an important reinforcement of the corners of the box, considerably increasing its mechanical strength and furthermore constituting resting surfaces adapted to sustain the loads which are formed and to be able properly to take up the vertical pressures which are developed during the stacking.

Furthermore, it can be noted that from the upper edge of each corner there extend ridges, each of which nests with a soft fit in coinciding slots produced in the lower edge of each corner of the box which is arranged in a contiguous upper plane upon stacking. Such slots only slightly affect the bottom of the container and are not noticed from the inside of the container, whereby the corners of the box are not weakened.

FIG. 2 is an enlarged detail of the arrangement formed at each corner of the box and it can be seen that by the extensions or flaps which extend along both sides of the ends there is formed on each corner a triangular prism which is stabilized and held by the end sector of the flap itself, the end sector having its vertical edge smoothed in order to avoid damage to the packed products which might rub against the vertical edge.

Figure 3:
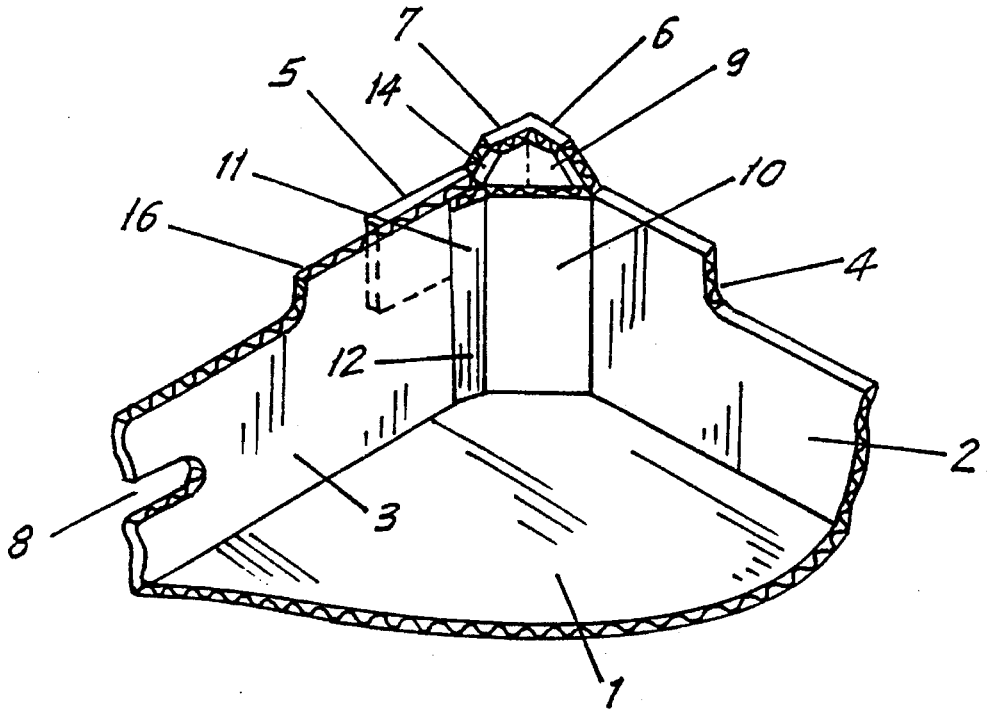
FIG. 3 is a fragmentary perspective view of the corner of the container according an alternative embodiment of the present invention.

FIG. 3 is a fragmentary view showing, in perspective, one corner of the container in which, from the upper edge of each corner, there extend two angular ridges arranged back to back and one coupled between the wings of the other, thereby forming a very strong mutual engagement between the stacked boxes.

Figure 4:
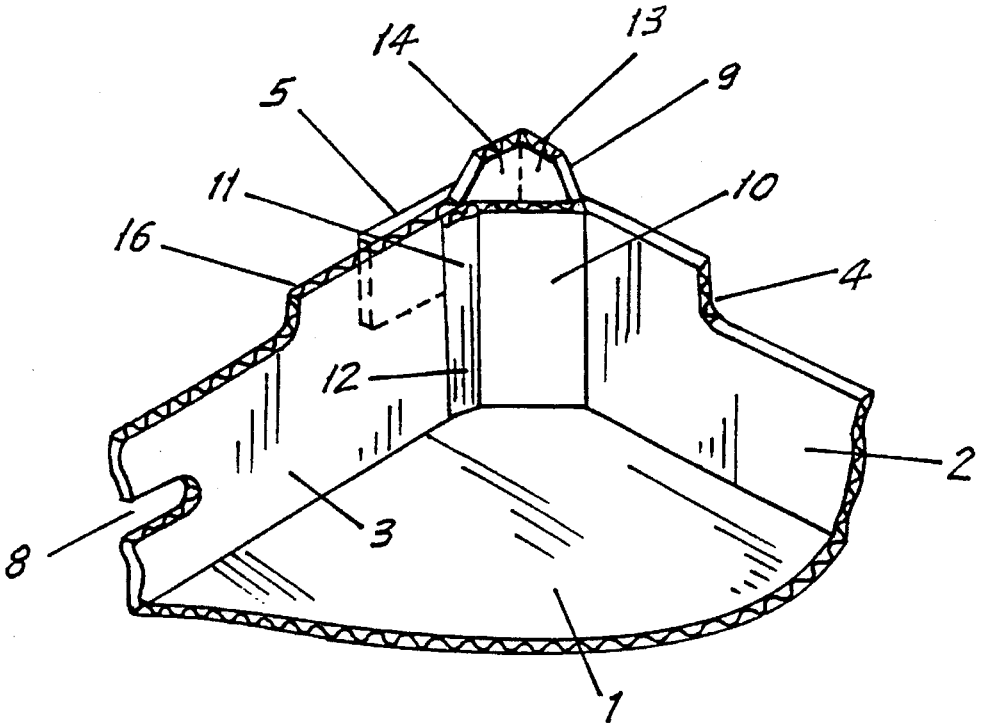
FIG. 4 is a fragmentary perspective view of the corner of the container according to another embodiment of the present invention.

In FIG. 4 there is shown an embodiment of the container in which, on the upper edge of its corners, there is a single annular ridge formed by prominences which extend from the edge of the end and from the first sector of the flap which is articulated on the side of the end itself. The flap thus formed will nest in a coinciding slot in the upper box which is not visible from the inside of the container and which is noticeable from the outside only by a cut made in the end of the lower edge of the corresponding long side.

Referring now to these drawings, it is pointed out that the improved container which is proposed is formed from a single board, preferably but not exclusively corrugated cardboard, which is shaped by the corresponding stamping process, defining a substantially rectangular central sector which constitutes the bottom 1, the long sides or cheeks being designated 2, and the ends being designated 3.

The long sides 2 are cut on the upper edge over the central zone, forming an offset 4 so that, upon the stacking of the boxes, there is formed between each of the superimposed boxes a large space to permit the aeration of the packed perishable products.

The long sides 2 have on both ends extensions or flaps 5 which are folded 90° to be applied and adhere to the outer surface of the adjoining end 3, surrounding the corresponding corner of the box.

By the embodiment described, the long sides 2 firmly hold the ends 3 from the outside and form, on the upper edge of each corner of the box, angular ridges 6, 7 form an angular ridge member which constitutes the nesting means between every two stacked boxes. In order to establish this nesting, it is provided that the lower edge of the corners of the box has recesses which coincide with the ridges in question so that the box located in the adjoining upper plane is physically held between the four angular ridges which extend from the upper edge of each corner of the box located on the lower plane.

These arrangements furthermore provide a wide seat for the superposed box which in rest will full security on the upper edge 15 of the cheek 2, on the upper edge 16 of the end 3 and of the extension 5 of the adjoining long side, and on the edge 17 of the triangular prism 9.

As can be noted from the drawings, particularly from FIG. 2, the ends 3 have, articulated at their ends, extensions or flaps which are divided by perforation lines into three successive sectors 9, 10 and 11, which are rolled up to form, in the corners of the box, triangular prisms intended to act as resting surfaces for the box which is located in the adjoining upper plane.

The first sector 9 of the prism indicated rests against and is optionally attached to the inner surface of the contiguous long side 2; the second sector 10 is located transversely between the long side 2 and the end 3, closing the corner of the box, and the third sector 11, which is narrower than the previous ones, is applied against the end 3 itself, to which it is fastened by gluing or stitching.

From FIG. 2, it can be noted that the vertical edge 12 of said third sector 11 has been beveled, or else reduced by flattening of the material itself, thus eliminating the possibility of the existence within the container of sharp edges which might damage the products packed.

The nesting ridges which emerge from the edge of each corner of the box are indicated by the reference numerals 6 and 7 in the embodiment shown in FIG. 1, in which case said ridges extend from the upper edge of the long sides 2 and, at the corners of the box, form angular projections which nest in coinciding slots made in the lower edge of the container located on the adjacent lower plane, partially affecting the bottom 1 and the sides 2 and 3. The box which is superimposed will rest via its corners on the upper edge of the triangular prisms formed on the corners of the box, as well as on the edge of its long sides and on the ends, being physically held between the ridges 6, 7 which extend on each corner of the box located in the lower plane.

Referring now to FIG. 3, there can be noted the formation of angular nesting ridges of double thickness or double wall, the ridges being arranged back to back, one within the other. The outer ridge 6, 7 is formed by a protrusion which extends from the long side or cheek 2 and from its lateral extension 5; the inner ridge is formed by the protrusion 13, 14 which extends from the edge of the end 3 and from its first sector 9, which forms part of the prism 9, 10 and 11.

From FIG. 4, which has already been mentioned, it can be seen that, in accordance with the embodiment shown of the container proposed, the nesting ridges may be single, that is to say with a single thickness of material (FIG. 4), in which case the ridges are formed from the ends 3.

The recesses for receiving these ridges are made in the lower edge of each box and will be concealed by the lower part of each prism 9, 10 and 11. In all cases, these recesses will be visible from the outside of the box only from one of the sides in the cases represented by the ends 3.

On all the sides of the box, as well as on the bottom, strategically distributed holes can be made through which air can circulate, assisting in the good aerating of the products packed. Furthermore, a hole 8 may be made in the ends constituting a grip to facilitate the handling of the boxes formed.

The organization of the container which has been described makes it possible to form the container in the manner that the end extensions of its sides with which the reinforcement and support prisms in the corners of the box are formed, may extend from the ends or else from the sides, as may be convenient in each case.

Figure 5:
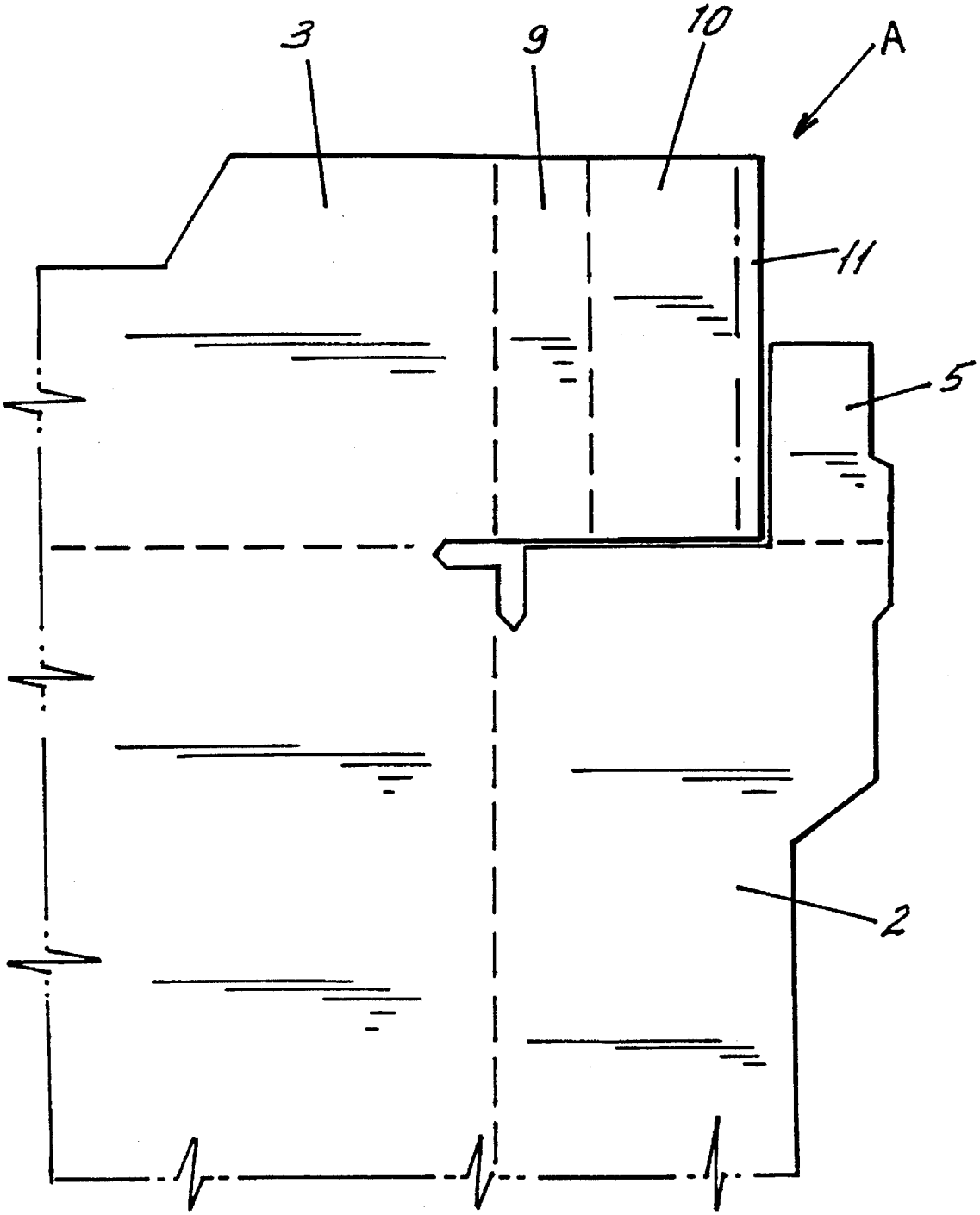
FIG. 5 is a plan view of a segment of a blank from which the carton of FIG. 1 can be formed.
Figure 6:
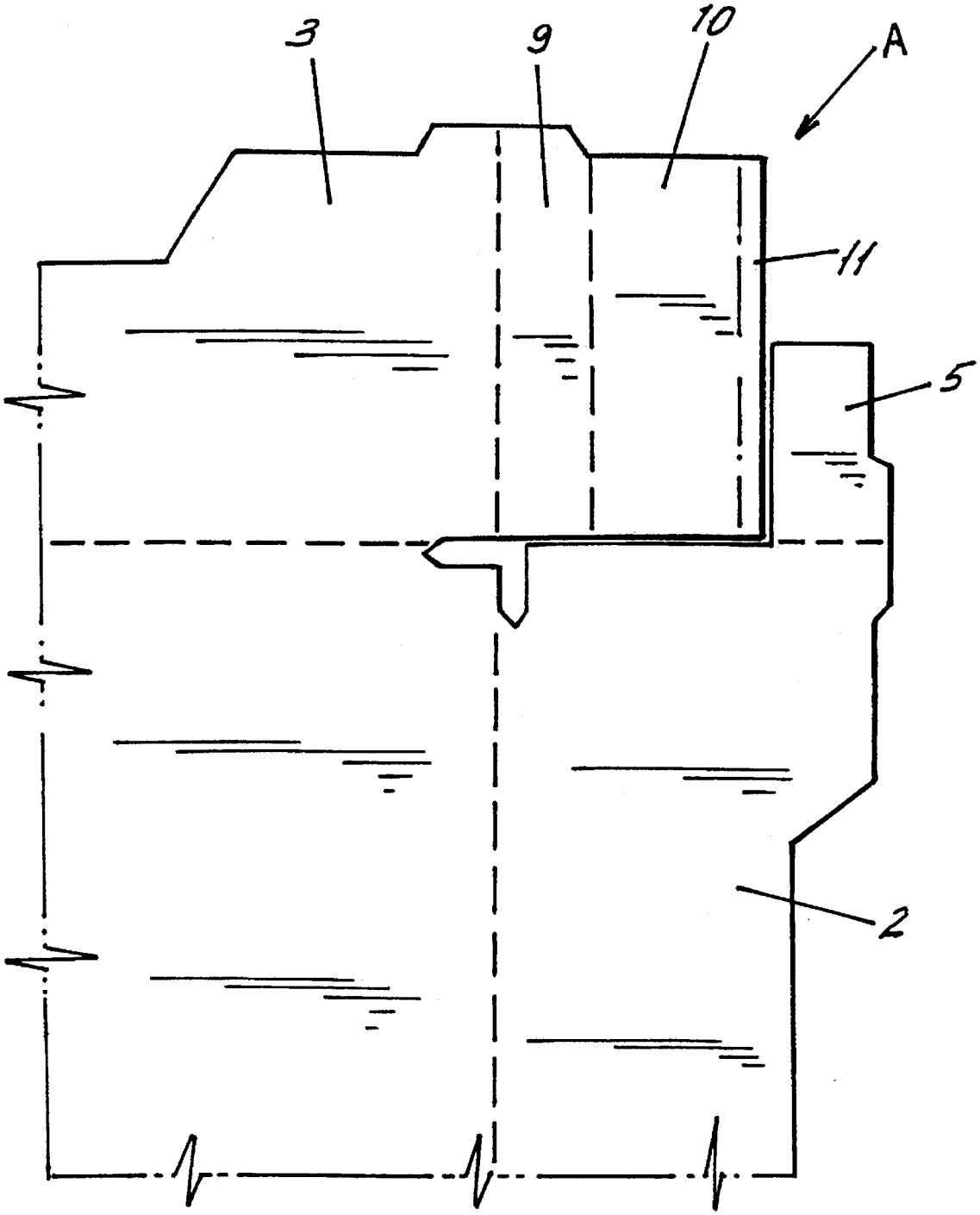
FIG. 6 is a plan view of a segment of a blank from which the container of FIG. 3 can be formed.
Figure 7:
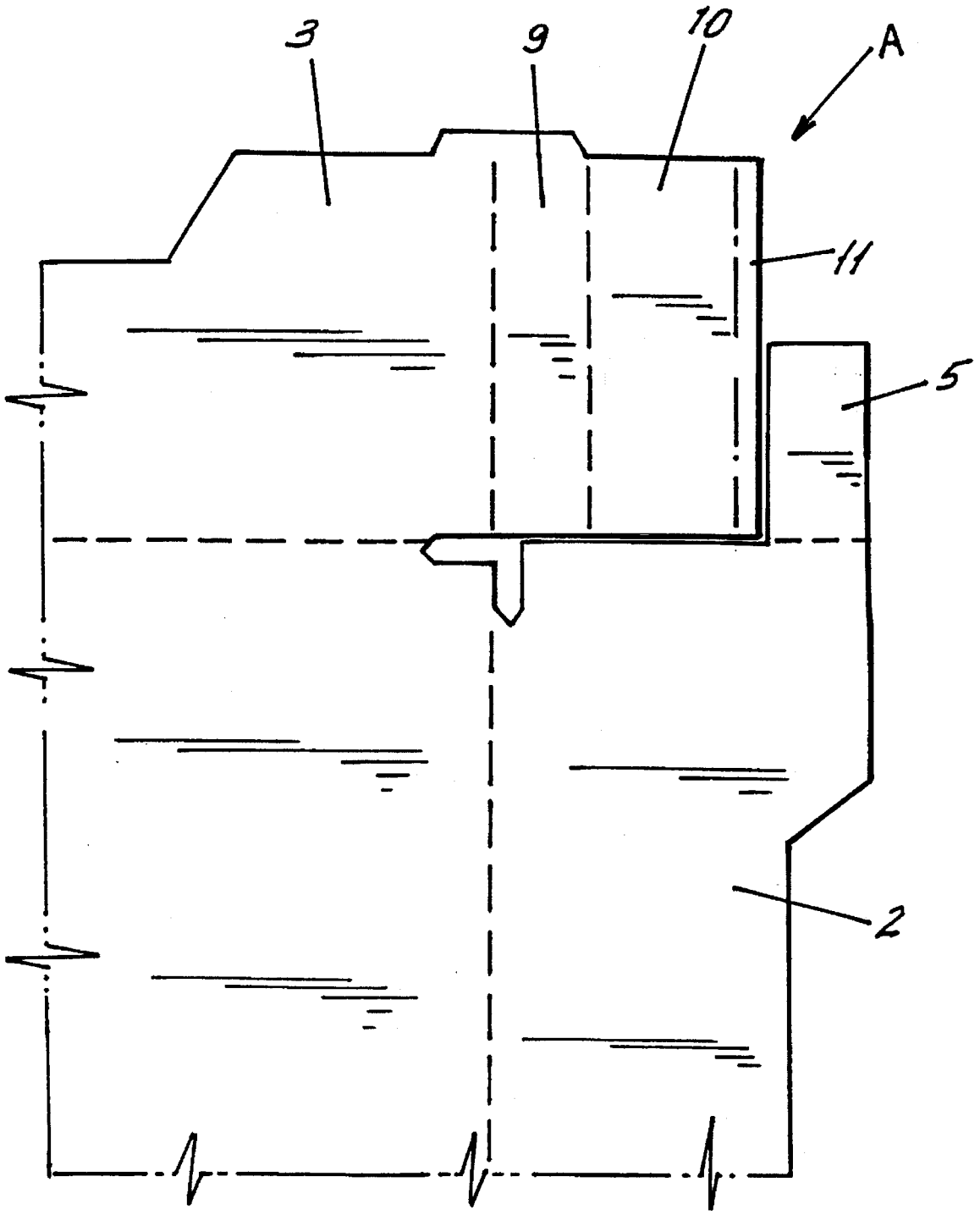
FIG. 7 is a plan view of a segment of a blank from which the container of FIG. 4 can be formed.

Referring to FIGS. 5, 6, and 7, the corners of the containers shown in FIGS. 1, 3, and 4, respectively, can be formed from a segment A of a blank comprising a single board, such as corrugated cardboard, which has been scored and slit to form a series of foldably connected panels as shown by the dashed fold lines in FIGS. 5, 6, and 7. By folding along the fold lines, the partial blanks of FIGS. 5, 6, and 7 are formed into the corners of cartons as shown in FIGS. 1, 3, and 4, respectively, wherein all of the elements of FIGS. 1, 3, and 4 are also depicted in the blanks A of FIGS. 5, 6, and 7.

The details set forth correspond essentially to the characteristic details and improvements made by the invention; however, it is pointed out that, for certain purposes, the model is not strictly limited to the embodiments set forth and shown, since, when reduced to practice, changes in detail may be introduced into it, provided that the essential nature of the container described is not modified thereby.

What is claimed is:

1. A light-weight container formed from a single piece of foldable material, comprising:

a bottom; and four sides, two of said sides each having an upper edge and, at opposite ends of said sides:

upward edge protrusions extending above said upper edge and forming a first part of an inner ridge; and extensions, each extension being divided into three successive sectors, each extension being folded to form in a respective corner of the container a triangular reinforcement and resting prism, a first of which sectors is bent at a right angle relative to the side from which it extends to rest against an inner surface of an adjoining side of the container and having an upward edge protrusion that extends above said upper edge of said side and forms a second part of said inner ridge, a second sector being located on an angle relative to said first sector, said second sector having an upper edge substantially level with said upper edge of said side, a third sector being located against and fastened to said side from which it extends, said third sector being separated laterally from the prism formed by said extension.

2. The light-weight container according to claim 1, wherein said inner ridges each have a top edge and side edges, and said side edges are obliquely angled to said top edge.

3. The light-weight container according to claim 2, wherein each of said inner ridges is dihedral in shape.

4. The light-weight container according to claim 1, wherein said second section is diagonal relative to both said first sector and said side from which it extends.

5. A blank for a light-weight container formed from a single piece of foldable material, the blank comprising:

a bottom;

two sides; and two opposite ends, each end having:

upper edges;

edge protrusions formed on opposite ends of said upper edges and extending beyond said upper edges for forming a first part of an inner ridge; and extensions formed on opposite sides of each end, said extensions being divided into three successive sectors, each extension being foldable in order to form in a respective corner of said container a triangular reinforcement and resting prism, a first of which sectors has a protrusion formed so as to extend beyond said upper edge for forming a second part of said inner ridge, said first sector for being bent at a right angle relative to the side from which it extends so as to rest against an inner surface of an adjoining one of said sides of the container, the second sector being formed so as to be located on an angle relative to said first sector and having an upper edge that is substantially level with said upper edge of said end when said container is formed, a third sector being narrower than said first and second sectors and being foldable to be located against and fastened to said end from which it extends, said third sector being separated laterally from the prism formed by said extension and having an upper edge which is substantially level with said upper edge of said end when said container is formed.

6. The blank for a light-weight container according to claim 5, further comprising flaps extending from opposite ends of each of said two sides, each flap having an outer ridge member that extends upwardly at a respective one of said corners above said upper edges of said ends so as to form a double-thick ridge with said inner ridge when said container is formed, said outer ridge member being adjacent to and aligned with said inner ridge member at each of said respective corners.

7. The blank for a light-weight container according to claim 5, wherein said inner ridges each have a top edge and side edges, said side edges being obliquely angled to said top edge, and said inner ridges being adopted to cooperate in the nesting, stabilization, and alignment of an identical container stacked thereon having an appropriate slot for receiving said inner ridges.

8. The light-weight container according to claim 7, wherein said inner ridges are dihedral in shape.

9. A stackable container formed from a single piece of foldable material, comprising:

a bottom panel;

two side panels and two end panels attached to said bottom panel, said side panels and said end panels forming corners of said container, said end panels having upper edges;

extensions formed at each said corner on an end of each of said end panels, each of said extensions being divided into first, second and third sectors, said end panel and said first and second sectors forming a triangular member in each said corner of said container, said first sector extending substantially at a right angle to said end panel, said second sector being disposed at an angle to said end panel, an upper edge of said second sector being substantially level with said upper edge of said end panel to provide a support ridge on which an upper container can be stacked and said third sector being adjacent to and affixed to said end panel;

inner ridge members extending upwardly from said upper edges of said end panels and said first sector at each of said corners of said container, said ridge members cooperate with said triangular members to enable the nesting, stabilization and support of the upper container stacked thereon having appropriate slots at corners of the upper container for receiving said ridge members; and at each said corner of said container, an end of each of said side panels having a flap being at an angle to said side panel and affixed at each of said corners, respectively, to an outer surface of an adjoining one of said end panels.

10. The stackable container of claim 9, wherein said inner ridge members each have a top edge and side edges, and each of said side edges is obliquely angled to said top edge.

11. The stackable container of claim 9, further comprising at each said corner, outer ridge members extending upwardly from each of said side panels and from each of said flaps at each of said corners of said container, each of said outer ridge members being positioned adjacent and coincident to a respective one of said inner ridge members at each of said corners, said outer ridge members being adapted to cooperate in the nesting, stabilization, and alignment of the upper container positioned on said stackable container having appropriate slots for receiving said ridge members.

12. The stackable container of claim 11, wherein each of said outer ridge members has a top edge and side edges, said side edges of said outer ridge members being obliquely angled to said top edge of said outer ridge members.

13. The stackable container of claim 12, wherein each of said top and side edges is shaped in a configuration similar to a shape of said respective inner ridge members, and said top and side edges of each outer ridge member are coextensive with the top and side edges of said respective inner ridge members.

14. The stackable container of claim 9, wherein said inner ridge members each have a top edge and side edges, said side edges being obliquely angled to said top edge, and said ridge members along its top and side edges is dihedral in shape.

15. The stackable container of claim 9, wherein said third sector is narrower than said first and second sectors.

16. The stackable container of claim 9, wherein said third sector has a free end which is beveled.

17. The stackable container of claim 9, wherein each of said sides includes openings for ventilation of products placed in said stackable container.

18. The stackable container of claim 9, wherein said sides have a region spaced from said corners being shorter in height than said side panel at said corners, and thereby providing ventilation to goods within said container even though another container is stacked thereon.

19. The stackable container of claim 9, wherein said second section is diagonal relative to both said first sector sand said side from which said second sector extends.

* * * * *